US009131752B2

(12) United States Patent
Moiseikin

(10) Patent No.: US 9,131,752 B2
(45) Date of Patent: Sep. 15, 2015

(54) JEWELRY STONE SETTING

(71) Applicant: Victor Vladimirovich Moiseikin, Yekaterinburg (RU)

(72) Inventor: Victor Vladimirovich Moiseikin, Yekaterinburg (RU)

( * ) Notice: Subject to any disclaimer, the term of this patent is extended or adjusted under 35 U.S.C. 154(b) by 0 days.

(21) Appl. No.: 14/351,924

(22) PCT Filed: Oct. 2, 2013

(86) PCT No.: PCT/RU2013/000865

§ 371 (c)(1),
(2) Date: Apr. 15, 2014

(87) PCT Pub. No.: WO2014/054979

PCT Pub. Date: Apr. 10, 2014

(65) Prior Publication Data

US 2014/0250949 A1 Sep. 11, 2014

(30) Foreign Application Priority Data

Oct. 3, 2012 (RU) ..... 2012142105

(51) Int. Cl.
*A44C 17/02* (2006.01)

(52) U.S. Cl.
CPC ..... *A44C 17/02* (2013.01)

(58) Field of Classification Search
None
See application file for complete search history.

(56) References Cited

U.S. PATENT DOCUMENTS 6,023,947 A * 2/2000 Afuku et al. ..... 63/26

FOREIGN PATENT DOCUMENTS

| | | | |
|---|---|---|---|
| DE | 3104396 | A1 | 8/1982 |
| FR | 002715541 | A1 * | 8/1995 |
| RU | 2178259 | C1 | 1/2002 |
| RU | 63186 | UI | 7/2002 |

* cited by examiner

*Primary Examiner* — Jack W Lavinder
(74) *Attorney, Agent, or Firm* — Nadya Reingand

(57) ABSTRACT

The invention relates to the jewelry industry. The present invention addresses the technical problem of securing a stone in an item of jewelry in a reliable and simple manner and in such a way that as little as possible of the stone is concealed. The proposed technical solution, which provides the appropriate degree of reliability in the securing of a stone in an item of jewelry, makes it possible to expose the stone to view to the maximum possible extent. The setting consists of a single ring, corresponding in shape to the bottom part of the cut stone, into which the stone is inserted, and a displaceable prong, which fastens the stone from above with a single point of contact. The proposed technical solution is suitable for use with stones of any cut.

4 Claims, 2 Drawing Sheets

JEWELRY STONE SETTING

RELATED APPLICATIONS

This patent application is a National stage application of PCT patent application PCT/RU2013/000865 filed Oct. 2, 2013, which claims priority to Russian patent application RU 2012142105 filed Oct. 3, 2012, currently issued as a Patent of Russian Federation RU2498750.

FIELD OF INVENTION

The invention relates to the jewelry industry. The technical challenge, solved with the help of the claimed invention, is the reliable and simple fixation of a stone to the jewelry product, with a minimal degree of concealment of the stone from view.

BACKGROUND

A known prong setting for stones in jewelry products, where the stone is secured using prongs (freestanding columns, which can be produced on the base of the product and as a separate element of the jewelry product—a holder). A disadvantage of this type of setting is the concealment from view of the stone in more than two places (the base and the locations covered by the prongs), connected using several prongs instead of one.

SUMMARY

A setting for stones of any type of cut in jewelry manufacturing is proposed. It includes a ring, having a form corresponding to the lower part of the stone being set, connected to the base of the piece of jewelry in two places, and one prong. The prong is connected to the base of the jewelry product in one place at the top part and configured to enable fixation of the stone at a point on the ring after positioning it on the top part. This ensures reliability and simplification of stone fixation in the jewelry product and minimal concealment of the stone from view.

DESCRIPTION OF THE PREFERRED EMBODIMENT

The proposed technical solution, providing analogous reliability levels of stone fixation in jewelry production, allows maximum exposure of the stone for viewing.

Figure 1:
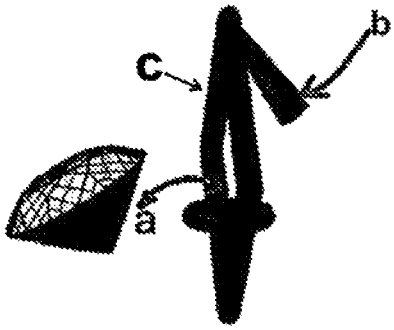
FIG. 1 shows the setting in open position.
Figure 2:
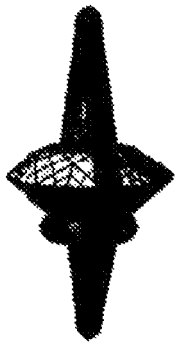
FIG. 2 shows the setting in closed position.

The setting consists of one ring a, corresponding to the shape of the lower part of the cut jewel, into which the stone is inserted, and a prong b, which shifts and pin-point secures the stone from above (FIG. 1—the setting in open position; FIG. 2—the setting in closed position).

The ring is connected from two opposite sides to the base of the piece of jewelry. The base has an upper portion above the stone and a lower portion below the stone girdle as shown in FIGS. 1-6. The prong is connected to the upper portion of the base at one point at the top and, being shifted to the table facet of the stone directly (perpendicular) above the center of the facet, provides stone fixation.

Figure 3:
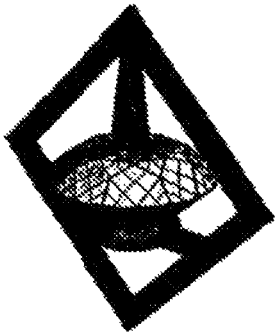
FIG. 3 shows a general view of the setting in closed position.
Figure 4:
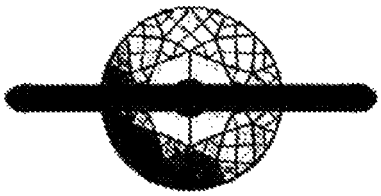
FIG. 4 shows the view from above of the setting in closed position.
Figure 5:
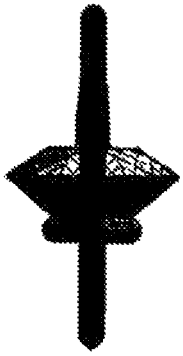
FIG. 5 shows the view from the side of the setting in closed position.
Figure 6:
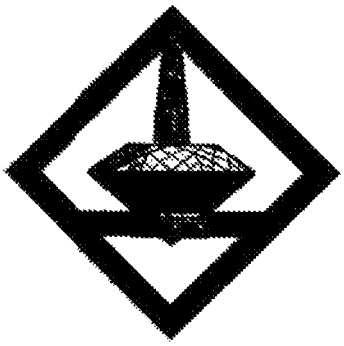
FIG. 6 shows the front view of the setting in closed position.

FIG. 3 shows a general view of the setting in closed position. FIG. 4 shows the view of the setting in closed position from above. FIG. 5 shows the view of the setting in closed position from the side. FIG. 6 shows the view of the setting in closed position from the front.

Figure 7:
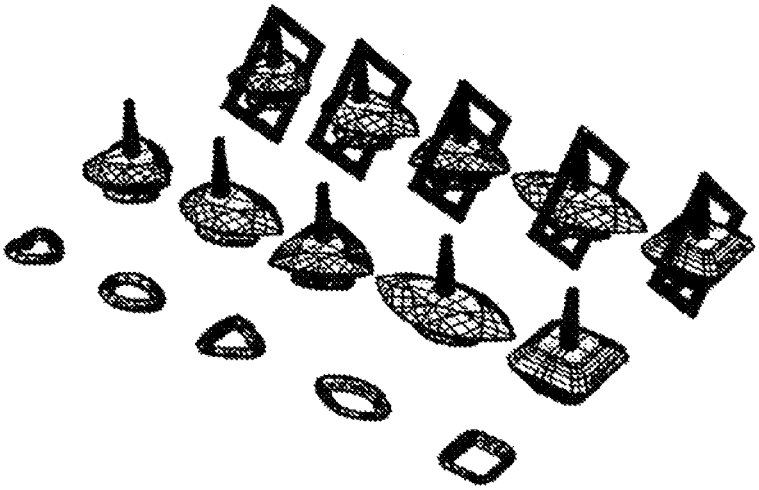
FIG. 7 shows implementations for stones of any cut.

The proposed technical solution is suitable for stones of any cut, as shown in FIG. 7.

The invention claimed is:

1. A piece of jewelry with a setting for stones of any cut comprising: a ring, having a form corresponding to a lower part of a stone being set, the stone sits firmly in the ring because a girdle of the stone is larger than the ring; the ring is connected to a base of the piece of jewelry, the base having an upper portion above the girdle and a lower portion below the girdle; the lower portion is connected to the ring in two places in opposite points of the ring, and a single prong displaceably connected to a top part of the upper portion of the base, the prong being directly above a center of a table facet of the stone; and the prong being able to shift from an open to a closed position engaging the table facet of the stone.

2. The piece of jewelry of claim 1, wherein the ring is circular.

3. The piece of jewelry of claim 1, wherein the ring is oval.

4. The piece of jewelry of claim 1, wherein the ring is square.

* * * * *